US010222070B2

(12) United States Patent
Cadima

(10) Patent No.: US 10,222,070 B2
(45) Date of Patent: Mar. 5, 2019

(54) GAS BURNER ASSEMBLY WITH A TEMPERATURE SENSOR

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 381 days.

(21) Appl. No.: 14/996,309

(22) Filed: Jan. 15, 2016

(65) Prior Publication Data

US 2017/0205076 A1 Jul. 20, 2017

(51) Int. Cl.

| | |
|---|---|
| ***F24C 3/08*** | (2006.01) |
| ***F24C 3/12*** | (2006.01) |
| ***F24C 15/10*** | (2006.01) |

(52) U.S. Cl.

CPC ..... *F24C 3/12* (2013.01); *F24C 3/085* (2013.01); *F24C 3/126* (2013.01); *F24C 15/107* (2013.01)

(58) Field of Classification Search

CPC ... F24C 3/082; F24C 3/12; F24C 3/042; A47J 27/62; A62C 3/006

USPC ..... 126/39 R; 239/594, 468, 472; 99/342

See application file for complete search history.

(56) References Cited

U.S. PATENT DOCUMENTS 2,148,777 A * 2/1939 Schneider ..... F23D 14/06 126/39 H
2,934,957 A * 5/1960 Reinhart ..... F24C 3/126 126/39 G
3,051,813 A * 8/1962 Busch ..... G05D 23/1906 219/448.14
3,220,460 A * 11/1965 Goubsky ..... F23C 7/004 431/238
3,746,499 A * 7/1973 Guerre ..... F23C 7/002 431/182
3,809,055 A * 5/1974 Craver ..... F24C 3/085 126/214 R
3,871,356 A * 3/1975 Saponara ..... F24C 15/107 126/214 C
3,922,137 A * 11/1975 Peczeli ..... F23C 7/004 239/406
4,351,632 A * 9/1982 Nagai ..... F23C 6/045 431/183
4,373,896 A * 2/1983 Zwick ..... F23C 7/004 431/174

(Continued)

FOREIGN PATENT DOCUMENTS

JP 59176521 A * 10/1984 ..... F24C 3/12
JP 10300104 A * 11/1998

(Continued)

*Primary Examiner* — Jimmy Chou
(74) *Attorney, Agent, or Firm* — Dority & Manning, P.A.

(57) ABSTRACT

A cooktop appliance includes a gas burner assembly positioned on a panel of the cooktop appliance and a grate that suspends the burner in air above the panel. The gas burner assembly includes an inwardly directed burner that defines a large aperture for providing secondary air to ensure a proper air/fuel mixture. A temperature sensor is positioned within the grate for measuring the temperature of the cooking utensil. The grate defines a channel that shields the temperature sensor from food spills and from the inwardly directed flame to ensure accurate temperature measurement.

19 Claims, 7 Drawing Sheets

(56) References Cited

U.S. PATENT DOCUMENTS 4,374,637 A * 2/1983 Zwick ..... F23C 7/004 431/183
4,646,963 A * 3/1987 Delotto ..... F24C 3/126 126/39 G
4,770,545 A * 9/1988 Takada ..... G01K 1/08 136/221
4,794,233 A * 12/1988 Goessler ..... H05B 3/748 219/445.1
4,969,815 A * 11/1990 Fukuda ..... F23D 14/24 431/116
5,046,477 A * 9/1991 Bennett ..... F24C 3/085 126/214 A
5,649,822 A * 7/1997 Gertler ..... F23D 14/06 126/39 E
6,131,561 A * 10/2000 Maxwell ..... F23D 14/065 126/214 D
6,132,205 A * 10/2000 Harneit ..... F23D 14/06 126/39 E
6,146,132 A * 11/2000 Harneit ..... F23D 14/06 126/39 E
6,322,354 B1 * 11/2001 Carbone ..... F23D 14/02 126/39 E
6,325,619 B2 * 12/2001 Dane ..... F23D 14/065 126/39 E
6,505,621 B2 * 1/2003 Gabelmann ..... F24C 15/10 126/214 R
6,537,065 B1 * 3/2003 Shirali ..... F23D 14/06 126/39 E
6,589,046 B2 * 7/2003 Harneit ..... F23D 14/06 126/39 BA
6,607,378 B2 * 8/2003 Harneit ..... F23D 14/06 126/39 E
6,806,444 B2 * 10/2004 Lerner ..... A47J 31/58 219/445.1
6,807,962 B2 * 10/2004 Taplan ..... F24C 3/085 126/214 A
6,966,315 B2 * 11/2005 Pickering ..... F24C 1/04 126/39 BA
7,291,009 B2 * 11/2007 Kamal ..... F23D 14/06 126/39 E
7,322,820 B2 * 1/2008 Welton ..... F23D 14/06 126/39 E
7,554,060 B2 * 6/2009 England ..... F24C 7/082 219/412
7,614,877 B2 * 11/2009 McCrorey ..... F23D 14/06 126/39 E
8,206,148 B2 * 6/2012 Paesani ..... F23D 14/065 126/39 E
8,535,052 B2 * 9/2013 Cadima ..... F23D 14/06 126/214 R
8,616,193 B2 * 12/2013 Padgett ..... F23D 14/06 126/39 E
8,667,958 B2 * 3/2014 Cadima ..... F24C 7/082 126/213
8,899,972 B2 * 12/2014 Fowler ..... F23D 14/06 126/39 E
9,074,765 B2 * 7/2015 Armanni ..... F23D 14/065
9,109,803 B2 * 8/2015 Motabar ..... F24C 15/10
9,119,248 B2 * 8/2015 Motabar ..... H05B 33/0806
9,132,302 B2 * 9/2015 Luongo ..... A62C 3/006
9,476,598 B2 * 10/2016 Paller ..... F24C 14/025
9,541,294 B2 * 1/2017 Angulo ..... F24C 3/08
9,696,039 B2 * 7/2017 Cadima ..... F24C 3/122
9,702,551 B2 * 7/2017 Cadima ..... F23D 14/84
9,791,156 B2 * 10/2017 Cadima ..... F24C 3/085
9,909,764 B2 * 3/2018 Bach ..... H05B 1/0266
2003/0022123 A1 * 1/2003 Wolf ..... F23D 11/103 431/354
2003/0024525 A1 * 2/2003 Jennings ..... F23D 14/045 126/39 R
2004/0069297 A1 * 4/2004 Cadima ..... F24C 15/107 126/214 C
2004/0195399 A1 * 10/2004 Molla ..... F23D 14/06 239/594
2004/0241604 A1 * 12/2004 Cadima ..... F23D 14/06 431/354
2005/0056268 A1 * 3/2005 Panchapagesan ..... F24C 3/085 126/39 E
2006/0051718 A1 * 3/2006 Kamal ..... F23D 14/06 431/354
2007/0068505 A1 * 3/2007 Cadima ..... F24C 3/027 126/39 E
2007/0151556 A1 * 7/2007 Cadima ..... F24C 3/085 126/39 E
2007/0224562 A1 * 9/2007 Hiromitsu ..... F23C 7/002 431/182
2009/0165777 A1 * 7/2009 Cadima ..... F23D 14/06 126/39 E
2010/0005976 A1 * 1/2010 Inzaghi ..... F23D 14/06 99/444
2010/0035197 A1 * 2/2010 Cadima ..... F23D 14/06 431/285
2011/0067577 A1 * 3/2011 Riddle ..... A47J 36/34 99/339
2011/0151385 A1 * 6/2011 Lona Santoyo ..... F23D 14/06 431/2
2011/0290231 A1 * 12/2011 Padgett ..... F23D 14/06 126/215
2013/0092149 A1 * 4/2013 Lona Santoyo ..... F24C 3/085 126/39 E
2013/0174837 A1 * 7/2013 Cadima ..... F23D 14/06 126/39 E
2013/0233296 A1 * 9/2013 Cadima ..... F23D 14/06 126/39 E
2014/0167643 A1 * 6/2014 Motabar ..... H05B 33/0806 315/297
2014/0190467 A1 * 7/2014 Cadima ..... F23D 14/06 126/39 E
2014/0238384 A1 * 8/2014 Cadima ..... F23D 14/06 126/39 E
2015/0040887 A1 * 2/2015 Angulo ..... F24C 3/08 126/39 E
2015/0144123 A1 * 5/2015 Cadima ..... F24C 3/126 126/39 R
2015/0159881 A1 * 6/2015 Cadima ..... F24C 3/126 126/39 E
2015/0219340 A1 * 8/2015 Cadima ..... F23D 14/06 126/39 E
2015/0345799 A1 * 12/2015 Cadima ..... F24C 3/085 126/39 E
2016/0025347 A1 * 1/2016 Cadima ..... F23D 14/06 126/39 E
2016/0025348 A1 * 1/2016 Cadima ..... F24C 3/085 126/39 E
2016/0033139 A1 * 2/2016 Cadima ..... F23D 14/06 126/39 E
2016/0102866 A1 * 4/2016 Cadima ..... F24C 3/085 126/39 E

FOREIGN PATENT DOCUMENTS

JP H1163506 A 3/1999
JP 3348393 B2 11/2002
JP 2006084119 A 3/2006

* cited by examiner

GAS BURNER ASSEMBLY WITH A TEMPERATURE SENSOR

FIELD OF THE INVENTION

The present subject matter relates generally to cooktop appliances, such as a gas cooktop appliance with gas burner assemblies.

BACKGROUND OF THE INVENTION

Generally, gas cooktop appliances include a plurality of gas burners mounted to a top surface of the appliance. Conventionally, these burners have had flames that travel radially outward from the gas burner. While this approach works well to heat a majority of the cooking utensil surface, the center most portion of the cooking utensil does not get the same heat transfer rates as the perimeter and uneven heating results.

To overcome this inherent uneven heating, inwardly directed burners are available which direct the flames radially inward from a burner having an open center. In this manner, inwardly directed burners heat a cooking utensil more uniformly by directing flames such that they converge at the center of the cooking utensil before traveling back out the sides of the cooking utensil in a radial fashion. In order to provide sufficient secondary air to ensure the fuel burns cleanly, current designs require that these inwardly directed burners have large, open centers.

Some conventional cooktop appliances also have spring-loaded temperature sensors for measuring the temperature of the cooking utensil while heating. To ensure proper contact of the temperature sensor with the cooking utensil, these sensors typically pass vertically through the center of the burner and extend slightly above the top surface of the grate. However, the use of a temperature sensor within the flame paths of inwardly directed burners can cause errors in the temperature measurements due to the direct exposure of the temperature sensor to the inwardly directed flame.

In addition, during use of the cooktop, openings in the burners to accommodate temperature sensors may allow spills and overflows to easily pass down into the interior of the cooktop and onto the temperature sensor. This can lead to food particles accumulating on the cooktop and on the temperature sensor. Due to the proximity of the burner, the accumulated food particles have a tendency to burn onto these parts and can be difficult to clean. In addition, gas burners that are fastened to the cooktops generally include cracks at assembly interfaces and include holes, supporting geometry, and fasteners that tend to accumulate food particles and are difficult to clean around. Significant disassembly is often needed to clean the spills. Thus, a serious drawback to this design is the ability to clean spills and users frequently cite difficulty cleaning beneath the gas burners as a complaint about modern cooktops.

Accordingly, a cooktop appliance with features for accurately measuring the temperature of a cooking utensil on a gas burner assembly is desirable. More particularly, a cooktop appliance having an inwardly directed burner and a spring-loaded temperature sensor for accurately measuring the temperature of a cooking utensil would be particularly beneficial.

BRIEF DESCRIPTION OF THE INVENTION

The present subject matter provides a cooktop appliance. The cooktop appliance includes a gas burner assembly positioned on a panel of the cooktop appliance and a grate that suspends the burner in air above the panel. The gas burner assembly includes an inwardly directed burner that defines a large aperture for providing secondary air to ensure a proper air/fuel mixture. A temperature sensor is positioned within the grate for measuring the temperature of the cooking utensil. The grate defines a channel that shields the temperature sensor from food spills and from the inwardly directed flame to ensure accurate temperature measurement. Additional aspects and advantages of the invention will be set forth in part in the following description, or may be apparent from the description, or may be learned through practice of the invention.

In a first exemplary embodiment, a gas burner assembly for a cooktop appliance is provided. The gas burner assembly includes a grate configured for supporting a cooking utensil above a panel of the cooktop appliance. A cap is integrally formed with the grate, the cap defining an air passage extending vertically through a center of the cap. A base is mounted to the cap such that the cap and the base define a fuel chamber, the base further defining a circumferential wall defining a plurality of flame ports, the plurality of flame ports opening into the air passage. The gas burner assembly further includes a temperature sensor extending through the air passage and configured to measure the temperature of the cooking utensil supported on the grate. The temperature sensor is positioned within a channel in the grate to shield the temperature sensor from a flame generated when fuel flowing out of the plurality of flame ports is ignited.

In a second exemplary embodiment, a cooktop appliance is provided. The cooktop appliance includes a panel having a top surface and a bottom surface. A fuel orifice is mounted to the panel adjacent the bottom surface of the panel and a gas burner assembly is positioned on the panel at the top surface of the panel. The gas burner assembly includes a grate configured for supporting a cooking utensil above the panel of the cooktop appliance and a burner defining an air passage extending vertically through a center of the burner, the burner further defining a plurality of flame ports opening into the air passage from a fuel chamber. A temperature sensor is positioned within the air passage and configured to measure the temperature of the cooking utensil supported on the grate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
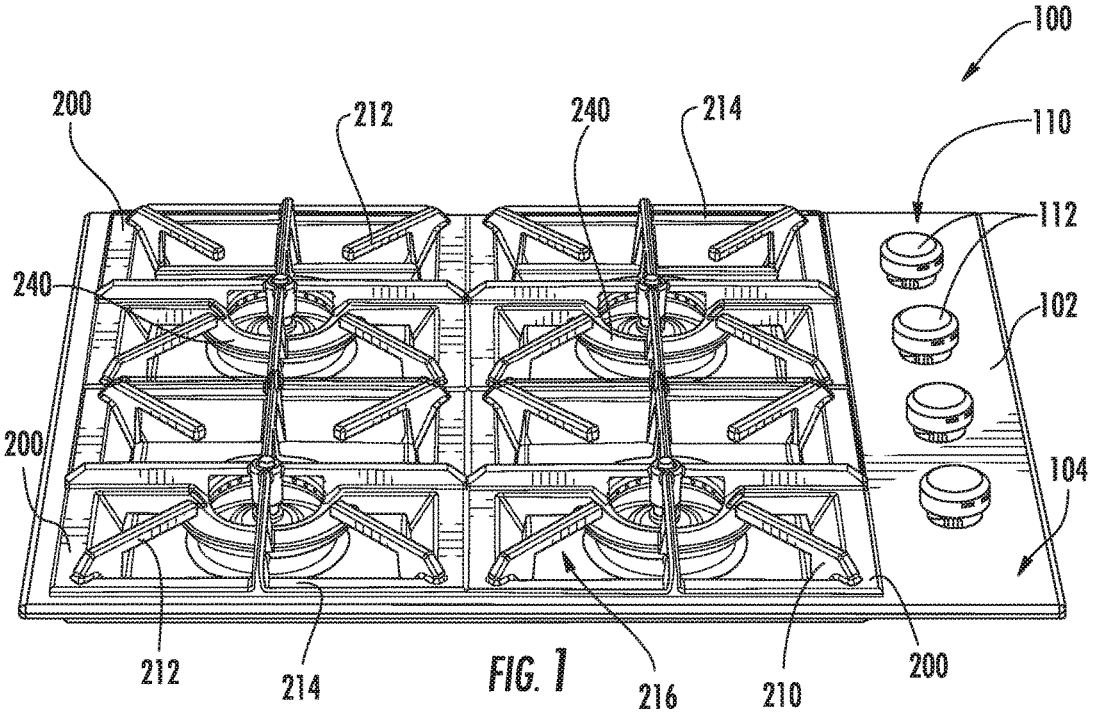
FIG. 1 provides a top, perspective view of a cooktop appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a panel 102, e.g., a top panel. By way of example, panel 102 may be constructed of enameled steel, stainless steel, glass, ceramics, and combinations thereof.

For cooktop appliance 100, a utensil holding food and/or cooking liquids (e.g., oil, water, etc.) may be placed onto gas burner assemblies 200 at a location of any of gas burner assemblies 200. Gas burner assemblies 200 can be configured in various sizes so as to provide e.g., for the receipt of cooking utensils (i.e., pots, pans, etc.) of various sizes and configurations and to provide different heat inputs for such cooking utensils. Gas burner assemblies 200 are supported on a top surface 104 of panel 102, as discussed in greater detail below. Gas burner assemblies 200 provide thermal energy to cooking utensils above panel 102.

A user interface panel 110 is located within convenient reach of a user of the cooktop appliance 100. For this exemplary embodiment, user interface panel 110 includes knobs 112 that are each associated with one of gas burner assemblies 200. Knobs 112 allow the user to activate each burner assembly and determine the amount of heat input provided by each gas burner assemblies 200 to a cooking utensil located thereon. User interface panel 110 may also be provided with one or more graphical display devices that deliver certain information to the user such as e.g., whether a particular burner assembly is activated and/or the level at which the burner assembly is set.

Although shown with knobs 112, it should be understood that knobs 112 and the configuration of cooktop appliance 100 shown in FIG. 1 is provided by way of example only. More specifically, user interface panel 110 may include various input components, such as one or more of a variety of touch-type controls, electrical, mechanical or electromechanical input devices including rotary dials, push buttons, and touch pads. User interface panel 110 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

Figure 2:
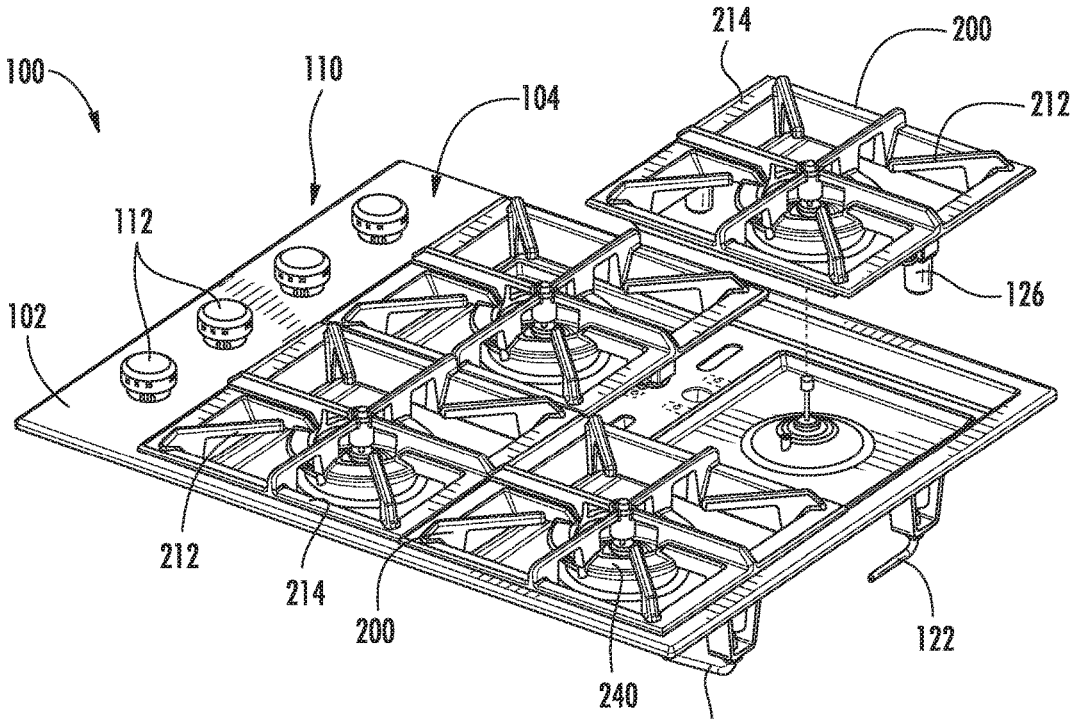
FIG. 2 provides another top, perspective view of the exemplary cooktop appliance of FIG. 1 with a gas burner assembly of the exemplary cooktop appliance shown removed from a panel of the exemplary cooktop appliance.

FIG. 2 provides another top, perspective view of cooktop appliance 100 with a gas burner assembly 200 of cooktop appliance 100 shown removed from panel 102 of cooktop appliance 100. As may be seen in FIG. 2, gas burner assembly 200 is removable from panel 102 of cooktop appliance 100. In certain exemplary embodiments, no mechanical fastening connects gas burner assembly 200 to panel 102. Thus, gas burner assembly 200 may not be fastened to panel 102, and a user may simply lift gas burner assembly 200 upwardly to remove gas burner assembly 200 from panel 102, as shown in FIG. 2. In such a manner, top surface 104 of panel 102 below gas burner assembly 200 may be easily accessible and cleanable.

Figure 3:
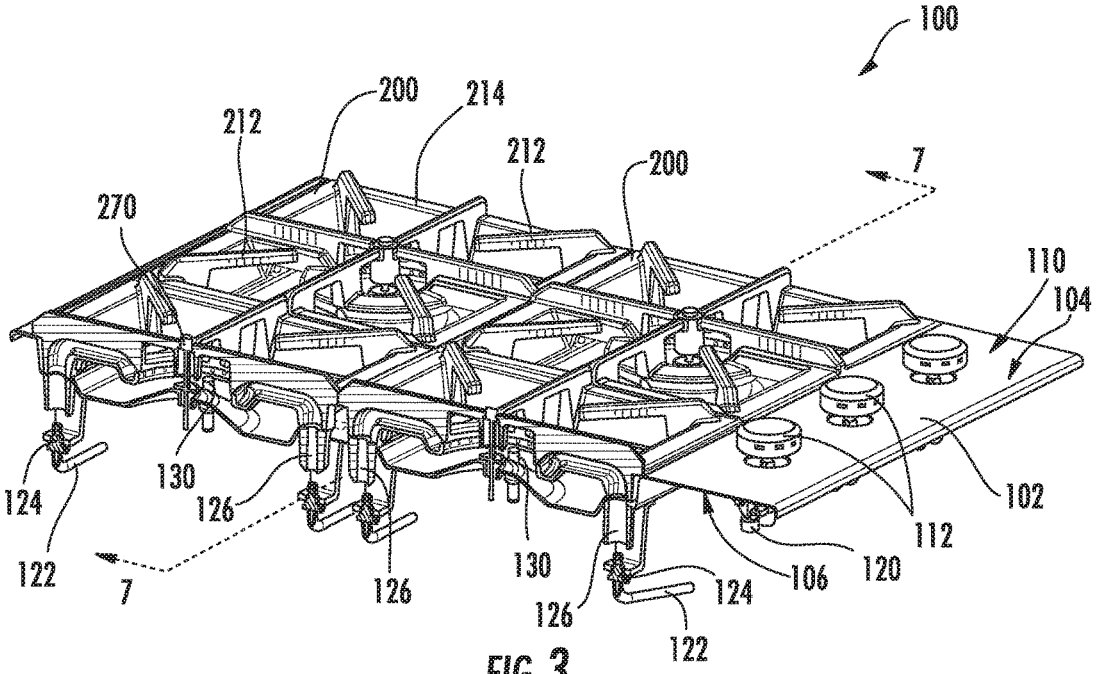
FIG. 3 provides a perspective, section view of the exemplary cooktop appliance of FIG. 1.
Figure 4:
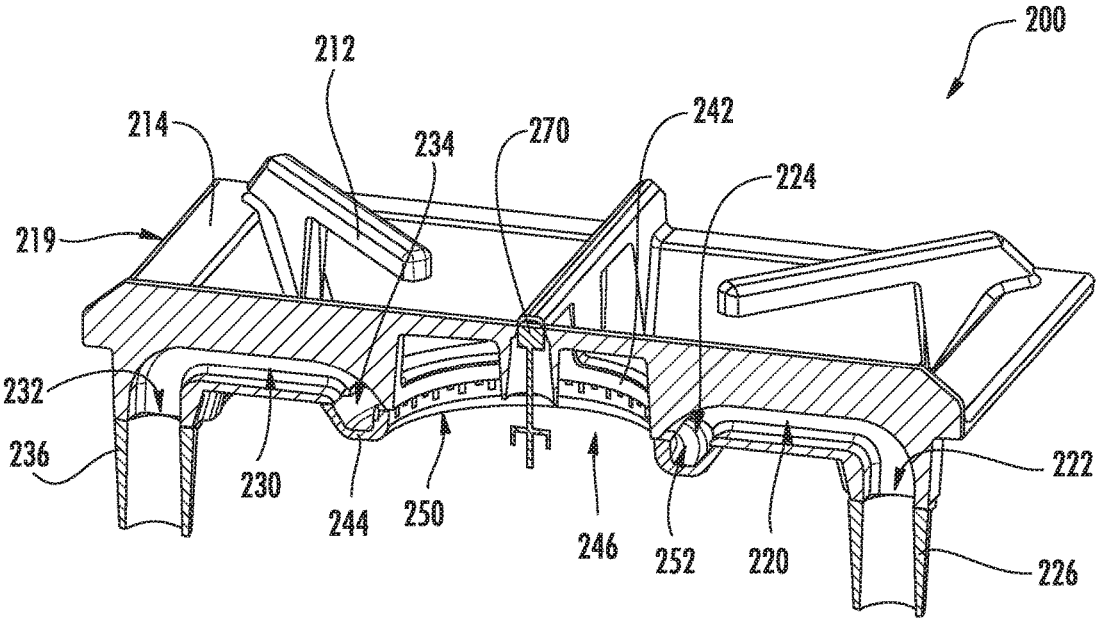
FIG. 4 provides a section view of the gas burner assembly of the exemplary cooktop appliance of FIG. 1.
Figure 5:
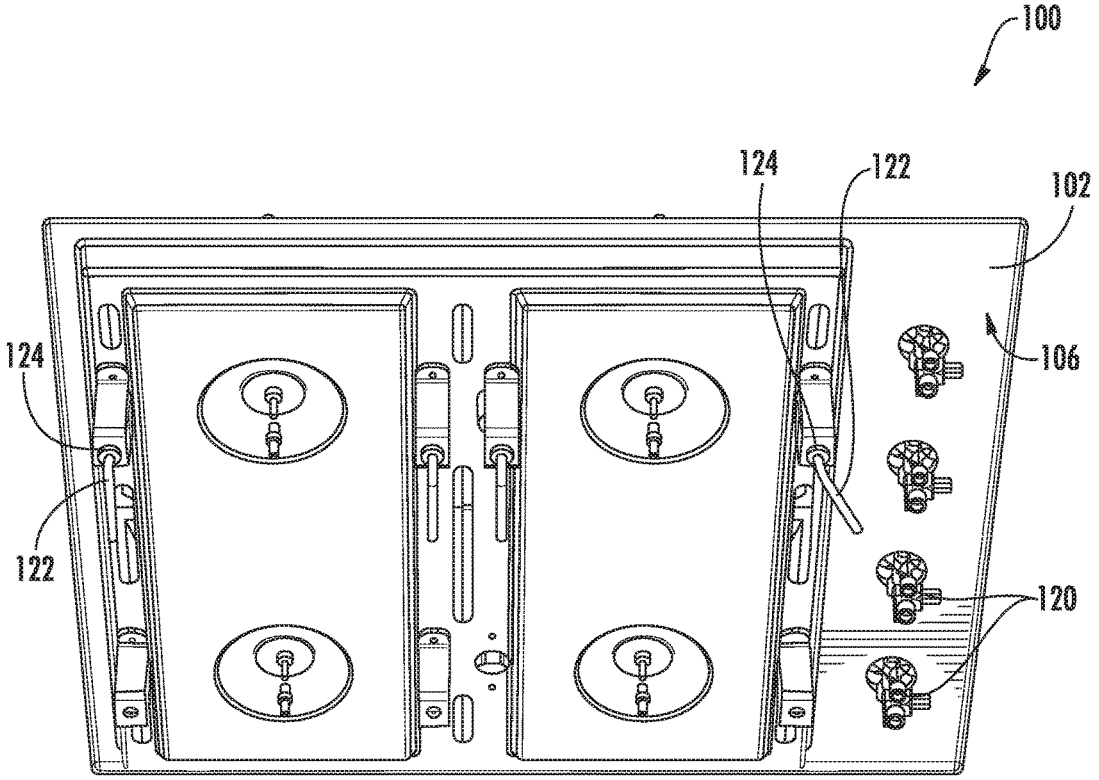
FIG. 5 provides a bottom, perspective view of the exemplary cooktop appliance of FIG. 1.
Figure 6:
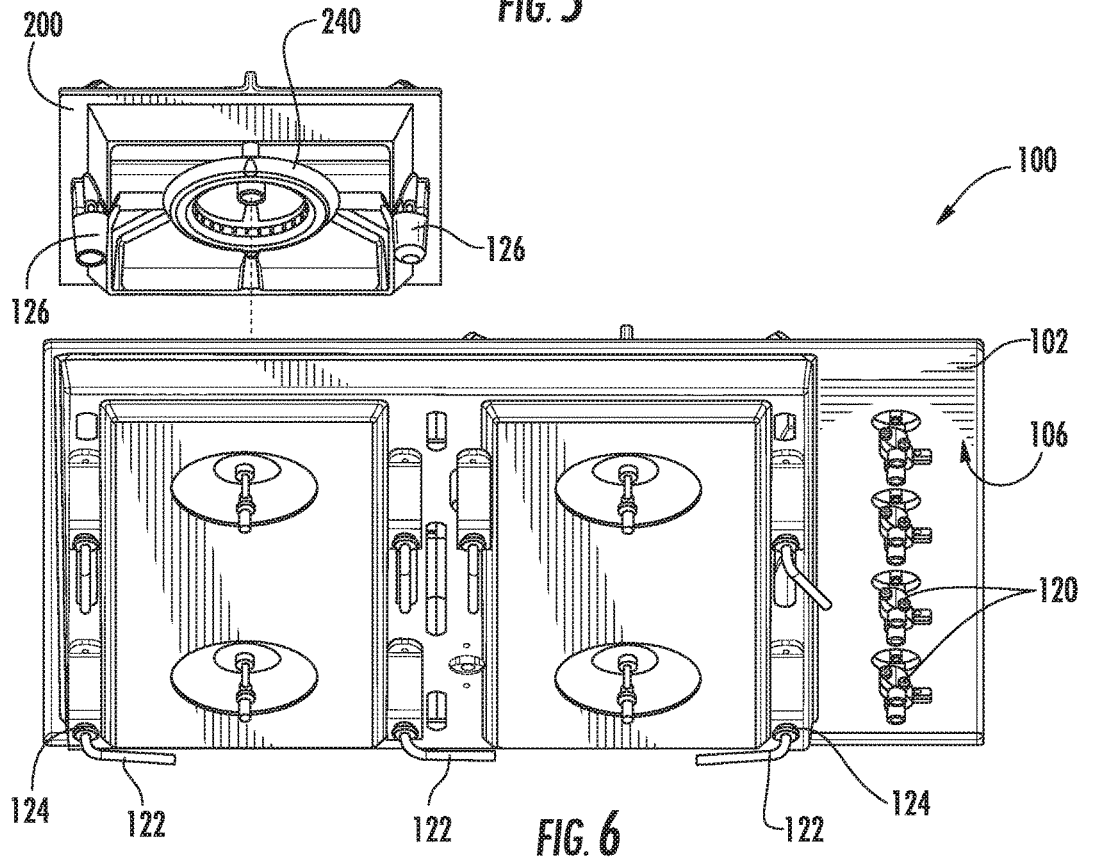
FIG. 6 provides another bottom, perspective view of the exemplary cooktop appliance of FIG. 1 with a gas burner assembly of the exemplary cooktop appliance shown removed from a panel of the exemplary cooktop appliance.

FIG. 3 provides a perspective, section view of cooktop appliance 100. FIG. 4 provides a section view of gas burner assembly 200. FIGS. 5 and 6 show bottom perspective views of cooktop appliance 100. As shown in FIGS. 3 through 6, cooktop appliance 100 includes control valves 120, fuel lines 122 and fuel orifices 124. Control valves 120 may be mounted to panel 102 at a bottom surface 106 of panel 102. Fuel lines 122 and fuel orifices 124 may also be positioned below panel 120, e.g., at or adjacent bottom surface 106 of panel 102.

Control valves 120 are each coupled to a respective one of knobs 112. Thus, a user may adjust control valves 120 with knobs 112. Control valves 120 are configured for regulating fuel flow to gas burner assemblies 200. For example, control valves 120 block fuel flow to gas burner assemblies 200 when control valves 120 are closed. Conversely, control valves 120 permit fuel flow to gas burner assemblies 200 when control valves 120 are open. A user may selectively adjust control valves 120 between the open and closed configurations with knobs 112 in order to regulate fuel flow to gas burner assemblies 200.

Fuel lines 122 extend between control valves 120 and fuel orifices 124. Thus, control valves 120 and fuel orifices 124 may be coupled to fuel lines 122. When control valves 120 are open, fuel, such as propane or natural gas, may flow through fuel lines 122 to fuel orifices 124. From fuel orifices 124, the fuel may flow into gas burner assemblies 200 where the fuel may be combusted, as discussed in greater detail below.

Between fuel orifices 124 and gas burner assemblies 200, fuel from fuel orifices 124 may entrain and mix with air. Cooktop appliance 100 includes features for assisting mixing of air and fuel as the fuel enters gas burner assemblies 200. In particular, cooktop appliance 100 includes mixing tubes 126 that receive the fuel and air and facilitate fluid mixing of the fuel and air. For example, mixing tubes 126 may be Venturi mixers that define tapered channels such that a pressure of the fuel and air decreases while a velocity of the fuel and air increases. Other suitable means for mixing fuel and air are also contemplated and within the scope of the present subject matter. Downstream of mixing tubes 126, the pressure of the fuel and air may increase while the velocity of the fuel and air decreases to further assist fluid mixing between the fuel and air entering gas burner assemblies 200.

Figure 7:
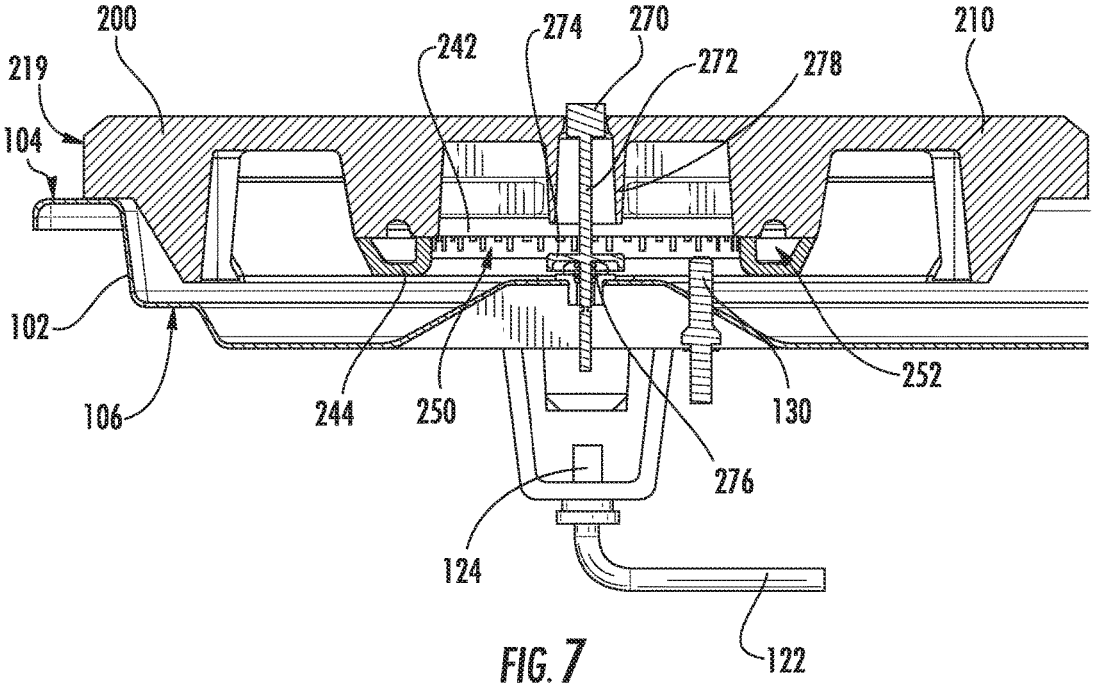
FIG. 7 provides a section view of the gas burner assembly of the exemplary cooktop appliance of FIG. 1, taken along Line 7-7 of FIG. 3.
Figure 8:
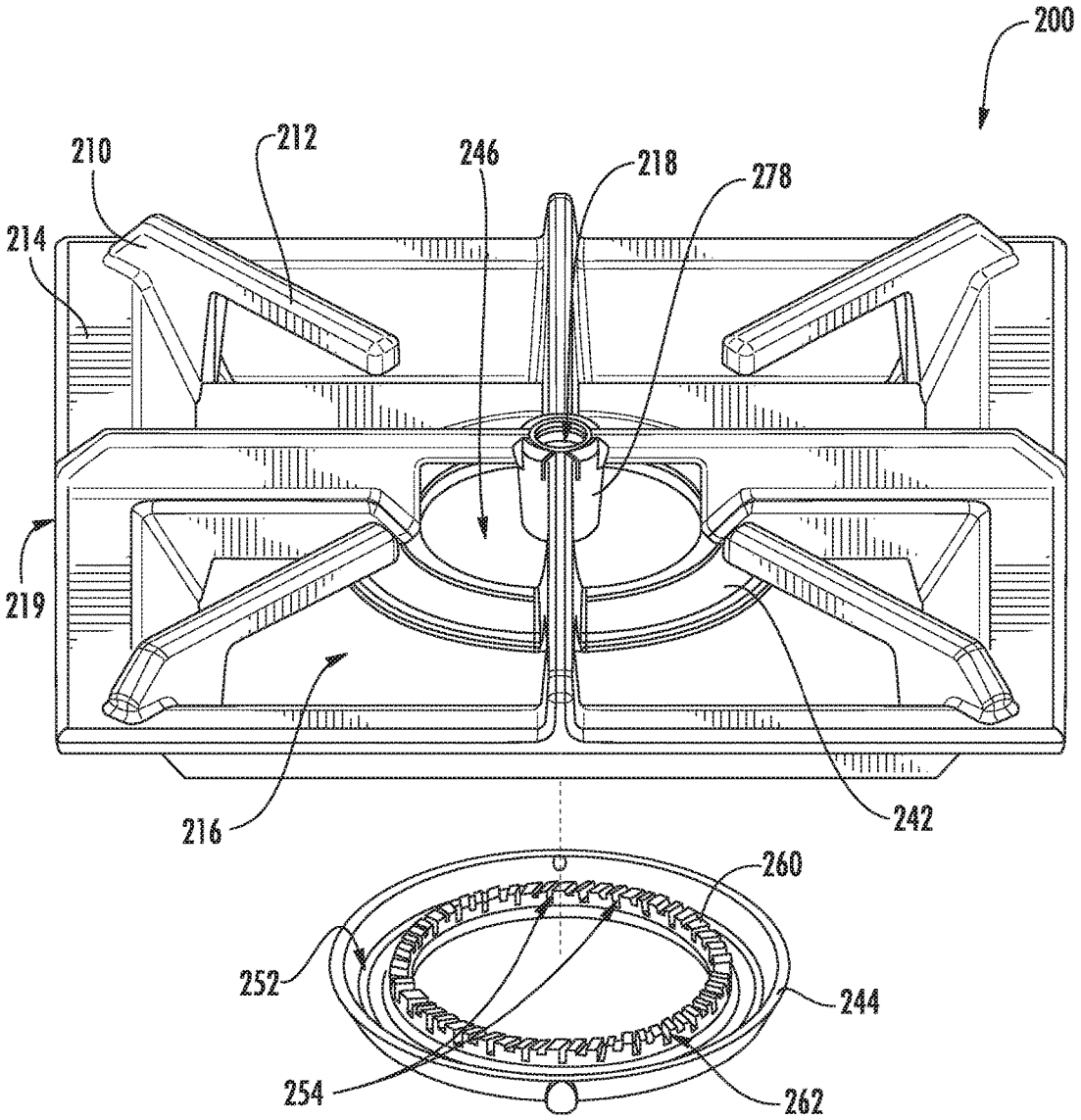
FIG. 8 provides an exploded, top perspective view of the gas burner assembly of the exemplary cooktop appliance of FIG. 1.
Figure 9:
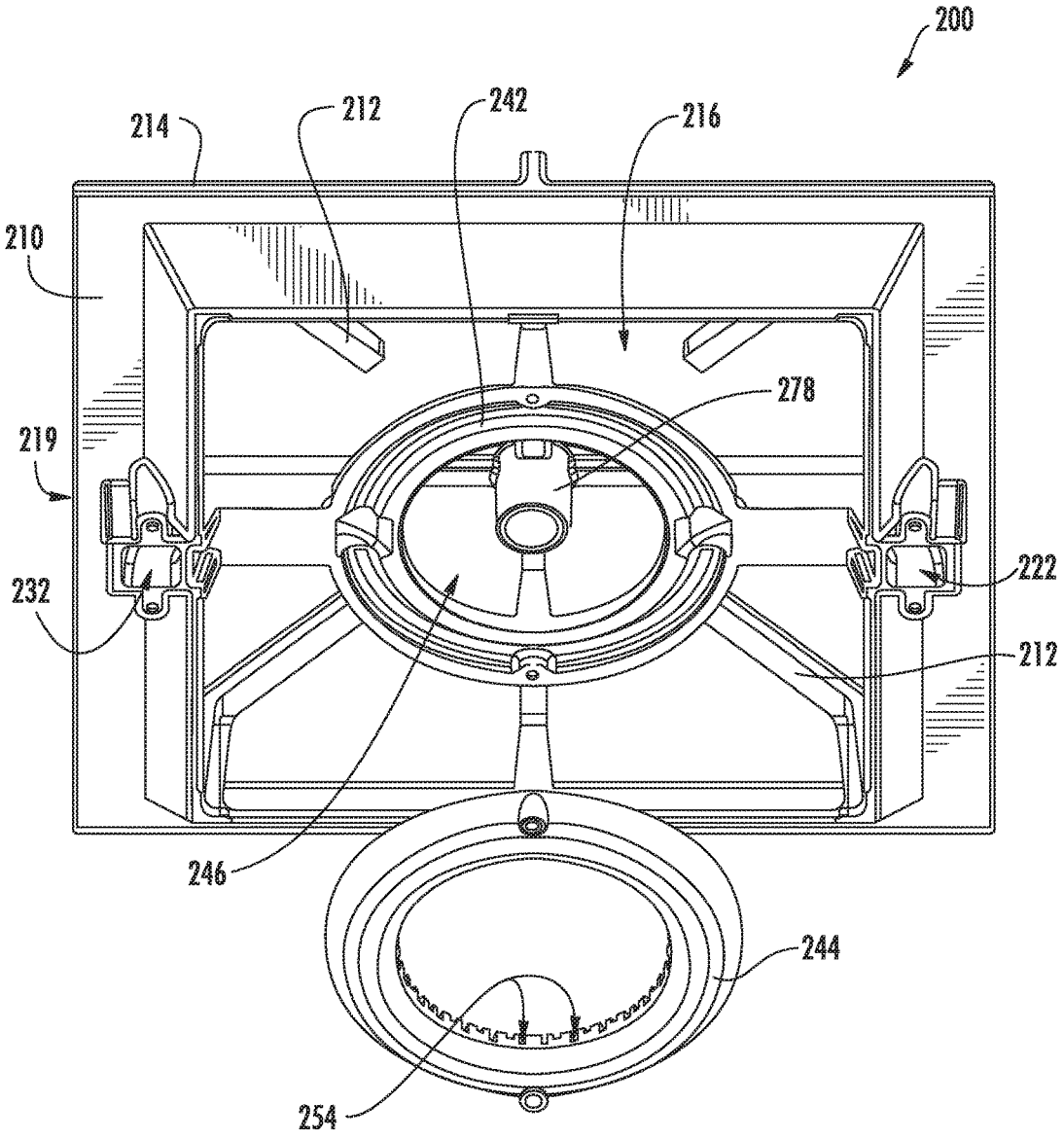
FIG. 9 provides an exploded, bottom perspective view of the gas burner assembly of the exemplary cooktop appliance of FIG. 1.

FIG. 7 provides a section view of gas burner assembly 200. FIG. 8 provides an exploded, top perspective view of one of gas burner assemblies 200. FIG. 9 provides an exploded, bottom view of gas burner assembly 200. Various features of gas burner assembly 200 are discussed in greater detail below in the context of FIGS. 3 through 9.

As may be seen in FIGS. 3 through 9, gas burner assembly 200 includes a grate 210 and a burner 240. Grate 210 is configured for supporting a cooking utensil, such as a pot, pan, etc. For example, grate 210 includes a plurality of elongated members 212, e.g., formed of cast metal, such as cast iron. The cooking utensil may be placed on the elongated members 212 of grate 210 such that the cooking utensil rests on an upper surface of elongated members 212. Elongated members 212 of grate 210 may include an outer frame 214 that extends around or defines a perimeter of grate 210 and/or gas burner assembly 200. Thus, outer frame 214 may be positioned at an outer portion 219 of grate 210. Grate 210 may rest on panel 102 at outer frame 214 of grate 200. Thus, a bottom surface of outer frame 214 may rest on top surface 104 of panel 102. As shown in FIG. 8, outer frame 214 of grate 210 may be square or rectangular in certain exemplary embodiments. Within outer frame 214, elongated members 212 may define an inner passage 216 that extends vertically through grate 210. Thus, fluid, such as air, may flow through grate 210 via inner passage 216.

As may be seen in FIG. 8, burner 240 may be positioned at a central portion 218 of grate 210. Thus, burner 240 may be positioned at or within inner passage 216 of grate 210, e.g., such that air within inner passage 216 of grate 210 flows by, around or through burner 240. Burner 240 may include a cap 242 and a base 244. Cap 242 of burner 240 may be mounted to grate 210. In particular, cap 242 may be integrally formed with grate 210, e.g., such that grate 210 and cap 242 of burner 240 are formed of or with a common piece of material. For example, grate 210 and cap 242 of burner 240 may be cast as a single, continuous piece of metal, such as cast iron.

Base 244 of burner 240 is mounted to cap 242 of burner 240, e.g., with fasteners, such that base 244 and cap 242 of burner 240 form flame ports of burner 240, as discussed in greater detail below. Thus, cap 242 of burner 240 and base 244 of burner 240 may be separate pieces of material, such as cast metal, that are mounted to each other to form burner 240. However, according to alternative embodiments, burner 240 may be formed from a single piece of material or from more than two pieces of material.

As shown in FIGS. 3 and 4, burner 240 includes a burner ring 250 positioned on grate 210. Burner ring 250 has a fuel chamber 252 and a plurality of flame ports 254. Cap 242 of burner 240 may define an inner air passage 246 that allows air to flow through burner 240 at burner ring 250. Fuel chamber 252 of burner ring 250 may extend circumferentially around passage 246 within base 244. FIG. 8 provides a top perspective view of base 244 of burner 240. As shown, fuel chamber 252 of burner ring 250 may further define a circumferential wall 260 that is positioned radially between the air passage 246 and fuel chamber 252 within burner 240.

According to the illustrated exemplary embodiment, circumferential wall 260 extends vertically and defines the plurality of flame ports 254, which extend from fuel chamber 252 to inner air passage 246. More particularly, according to one exemplary embodiment, flame ports 254 may be defined at least in part by a plurality of channels 262 (FIG. 8) that extend through circumferential wall 260. As shown, flame ports 254 are notched into an upper surface of circumferential wall 260. However, according to alternative exemplary embodiments, flame ports 254 may be formed in other suitable ways, such as, e.g., by drilling through circumferential wall 260. In addition, flame ports 254 are shown extending through circumferential wall 260 at an angle relative to a radial direction. In this regard, flame ports 254 create a flame pattern in the form of a swirl or vortex. Such a flame pattern may, for example, ensure that the fuel is more sufficiently aerated and may provide more uniform heating. One skilled in the art will appreciate that the size, shape, and orientation of flame ports 254 may be configured in any suitable manner to achieve desired fuel flow dynamics.

Although the illustrated embodiment shows burner 240 having a single burner ring 250, one skilled in the art will appreciate that the present disclosure is not so limited. For example, according to an alternative exemplary embodiment, burner 240 may be a multi-ring burner. For example, such a multi-ring burner may have an inner burner ring and an outer burner ring concentrically positioned such that outer burner ring extends around inner burner ring. An inner fuel chamber may be separated from an outer fuel chamber by a wall within burner, and burner may be configured to supply fuel to a plurality of flame ports on the inner burner and outer burner, respectively. Other configurations are also possible and within the scope of the present subject matter.

Referring back to FIGS. 3 and 4, grate 210 includes features for supplying fuel to burner 240, e.g., to burner ring 250. In particular, grate 210 defines a first internal fuel passage 220 and a second internal fuel passage 230. First and second internal fuel passages 220, 230 are configured for directing fuel through grate 210 to burner 240. According to the illustrated exemplary embodiment, first internal fuel passage 220 and second internal fuel passage 230 are contiguous with fuel chamber 252 of burner ring 250. Thus, fuel from fuel passages 220, 230 may flow into fuel chamber 252 of burner ring 250 and exit fuel chamber 252 of burner ring 250 at flame ports 254 where such fuel may be combusted. Although two fuel passages 220, 230 are shown, one skilled in the art will appreciate that only a single fuel passage may be needed according to alternative embodiments. Alternatively, if a multi-ring burner is used, each passage 220, 230 may be configured to provide fuel to a single ring of the multi-ring burner. Other configurations are also possible.

By mounting burner 240 to grate 210 and directing fuel through grate 210 to burner 240, cleaning panel 102 below gas burner assembly 200 may be facilitated. For example, as shown in FIG. 3, burner 240 may be mounted to grate 210 such that burner 240 is suspended above or spaced apart from top surface 104 of panel 102. With burner 240 separated from top surface 104 of panel 102, heat transfer between burner 240 and panel 102 may be limited. Thus, panel 102 may be cooler during operation of gas burner assembly 200 relative to burners that contact panel 102, and burning of spilled or overflowed food particles on top surface 104 of panel 102 may be reduced or limited. In addition, with burner 240 separated from top surface 104 of panel 102, access to panel 102 below burner 240 may be easier than compared to burners that are positioned on and mounted to panel 102, and a user may more easily reach below burner 240 to clean spills and overflows below burner 240. Further, by supplying fuel through grate 210, burner 240 need not receive fuel from directly below burner 240 through panel 102. Thus, panel 102 may have no holes, less holes and/or smaller holes directly below burner 240 relative to burners that are positioned on and mounted to panel 102 and receive fuel from directly below the burners. As shown in FIGS. 2 and 3, an igniter 130 may be mounted to panel 102 below burner 240, in certain exemplary embodiments.

As may be seen in FIGS. 3 and 4, at least a portion of first and second internal fuel passages 220, 230 may be positioned above flame ports 254 of burner 240. In particular, at least a portion of fuel passage 220, 230 may be positioned above flame ports 254 of burner ring 250. In such a manner, a vertical space occupied by gas burner assembly 200 may be reduced, and gas burner assembly 200 may have a compact vertical profile. In particular, utilizing first and second internal fuel passages 220, 230 to supply fuel to burner 240 assists with reducing a vertical height of gas burner assembly 200 relative to burners that deliver fuel to burners from below the flame ports due to the required spacing between the burners and a cooking utensil needed for proper combustion of fuel. In such a manner, cooktop appliance 100 may have a sleek, low profile that is preferred by certain consumers by delivering fuel to burner 240 through grate 210. As an example, a total vertical height of gas burner assembly 200 may be no greater than three inches in certain exemplary embodiments. According to the illustrated embodiment, grate 210 is configured such that a bottom of cap 242 is positioned below a counter surface when cooktop appliance 100 is installed on a counter.

First internal fuel passage 220 extends between an inlet 222 and an outlet 224. Inlet 222 of first internal fuel passage 220 is positioned at or adjacent outer portion 219 of grate 210. Conversely, outlet 224 of first internal fuel passage 220 is positioned at or adjacent central portion 218 of grate 210. Thus, first internal fuel passage 220 may extend between outer portion 219 and central portion 218 of grate 210 within one of the elongated members 212 of grate 210. First mixing tube 226 is positioned at inlet 222 of first internal fuel passage 220. First mixing tube 226 may also be positioned above one of fuel orifices 124, as shown in FIGS. 3 and 4. Thus, fuel from one of fuel orifices 124 may pass through first mixing tube 226 and enter first internal fuel passage 220 at inlet 222 of first internal fuel passage 220. Outlet 224 of first internal fuel passage 220 is contiguous with fuel chamber 252 of burner ring 250. Thus, fuel from first internal fuel passage 220 may flow into burner 240 via outlet 224 of first internal fuel passage 220.

Second internal fuel passage 230 also extends between an inlet 232 and an outlet 234. Inlet 232 of second internal fuel passage 230 is positioned at or adjacent outer portion 219 of grate 210. Conversely, outlet 234 of second internal fuel passage 230 is positioned at or adjacent central portion 218 of grate 210. Thus, second internal fuel passage 230 may extend between outer portion 219 and central portion 218 of grate 210 within one of the elongated members 212 of grate 210. Second mixing tube 236 is positioned at inlet 232 of second internal fuel passage 230. Second mixing tube 236 may also be positioned above one of fuel orifices 124, as shown in FIGS. 3 and 4. Thus, fuel from one of fuel orifices 124 may pass through second mixing tube 236 and enter second internal fuel passage 230 at inlet 232 of second internal fuel passage 230. Outlet 234 of second internal fuel passage 230 is contiguous with fuel chamber 252 of burner ring 250. Thus, fuel from second internal fuel passage 230 may flow into burner 240 via outlet 234 of second internal fuel passage 230.

As shown in FIGS. 3 and 4, first and second mixing tubes 226, 236 may be positioned opposite each other on gas burner assembly 200. In particular, burner 240 may be positioned between first and second mixing tubes 226, 236. Thus, first and second internal fuel passages 220, 230 may also be positioned opposite each other on gas burner assembly 200, and burner 240 may be positioned between first and second internal fuel passages 220, 230. In particular, outlet 224 of first internal fuel passage 220 may be positioned opposite outlet 234 of second internal fuel passage 230 on burner 240.

Grate 210 may be constructed of or with any suitable material. For example, grate 210 may be constructed of or with a single piece of cast metal. In particular, grate 210 may be formed of cast iron with first and second internal fuel passages 220, 230 formed within grate 210 using disposable cores during the casting process. First and second mixing tubes 226, 236 may also be integrally formed with grate 210 or may be separate components mounted, e.g., fastened, to grate 210.

As best illustrated in the exemplary embodiment of FIGS. 7 through 9, gas burner assembly 200 further includes a temperature sensor 270 that extends through inner air passage 246. Temperature sensor 270 is configured to measure the temperature of a cooking utensil supported on grate 210. Temperature sensor 270 may be a thermistor, a thermocouple, or any other device suitable for accurately measuring the temperature of the cooking utensil placed on grate 210.

As illustrated, temperature sensor 270 is disposed on the end of a shaft 272 that extends vertically through panel 102 upward to grate 210. A deflector 274 is fixed to shaft 272 proximate panel 102. Deflector may act as a shield to prevent food spills from splashing into the opening where temperature sensor 270 passes through panel 102.

In addition, a spring 276 may be disposed on shaft 272 between deflector 274 and panel 102. When no cooking utensil is placed on grate 210, spring 276 holds temperature sensor 270 such that a top portion of temperature sensor 270 extends above the top surface of grate 210. In this manner, as a cooking utensil is placed on the top surface of grate 210, the shaft is pressed down and spring 276 is compressed between deflector 274 and panel 102 to urge temperature sensor 270 into firm contact with the cooking utensil.

According to the illustrated embodiment, temperature sensor 270 is vertically oriented at center 218 of grate 210. This may be desirable, for example, to ensure that temperature sensor 270 contacts cooking utensils of any size. In addition, placing temperature sensor 270 at center 218 ensures that it is positioned as far as possible from flames exiting flame ports 254 of burner ring 250.

Especially when gas burner assembly 200 is operated at high temperatures, temperature sensor 270 may not accurately measure the temperature of the cooking utensil because it is directly exposed to flames exiting burner 250. For this reason, as shown in FIGS. 7 through 9, gas burner assembly may further include a channel 278 disposed at center 218 of grate 210. According to the illustrated embodiment, channel 278 is integrally formed with grate 210, e.g., such that grate 210 and channel 278 are formed of or with a common piece of material. For example, grate 210 and channel 278 may be cast as a single, continuous piece of metal, such as cast iron. According to alternative exemplary embodiments, channel 278 may instead be mounted to grate 210, e.g., by welding or using mechanical fasteners to attached channel 278 to elongated members 212. When mounted in this manner, channel 278 may be made from a different material than grate 210. For example, channel 278 may be constructed from an insulating ceramic material that may withstand the high temperatures generated by burner ring 250 but provide additional insulation to temperature sensor 270

Channel 278 may be cylindrical and have an internal diameter approximately equal to the diameter of temperature sensor 270. In this manner, channel 278 may assist in guiding temperature sensor 270 along the vertical direction and may minimize the size of potential openings where food spills may enter channel 278. Channel 278 may extend along the vertical direction for any length suitable for acting as a flame shield for temperature sensor 270. For example, according to the illustrated embodiment, channel 278 extends approximately between a top surface of grate 210 to a horizontal plane defined by flame ports 254. In this manner, channel 278 may shield temperature sensor 270 from flames generated when fuel flowing out of flame ports 254 is ignited.

Although the illustrated embodiment shows temperature sensor 270 mounted on the end of a vertically-oriented spring-loaded shaft 272 that extends through the center of channel 278, one skilled in the art will appreciate that this is only one exemplary embodiment and that other configurations are possible. For example, channel 278 may be positioned at any location within grate 210 and temperature sensor may be extended through channel using alternative mechanisms, such as a cantilevered arm extending from an outer portion 219 of grate 210. Other configurations are also possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for a cooktop appliance, the gas burner assembly comprising:

a grate configured for supporting a cooking utensil above a panel of the cooktop appliance;

a circular cap that is integrally formed with the grate, the circular cap defining an air passage extending vertically through a center of the circular cap;

a circular base that is mounted to the circular cap such that the circular cap and the circular base define a fuel chamber, the circular base further defining a circumferential wall defining a plurality of flame ports, the plurality of flame ports opening into the air passage;

a temperature sensor extending through the air passage and configured to measure a temperature of the cooking utensil supported on the grate; and a cylindrical channel formed by the grate and surrounding the temperature sensor to shield the temperature sensor from a flame generated when fuel flowing out of the plurality of flame ports is ignited, wherein the circular cap and the circular base are suspended above the panel of the cooktop appliance by the grate such that a bottom of the circular cap is positioned below a counter surface when the cooktop appliance is installed on a counter.

2. The gas burner assembly of claim 1, wherein the temperature sensor extends vertically through the panel of the cooktop and into a center of the air passage.

3. The gas burner assembly of claim 1, wherein the cylindrical channel extends vertically from a top surface of the grate to a horizontal plane defined by the plurality of flame ports.

4. The gas burner assembly of claim 1, wherein the temperature sensor is disposed on an end of a spring-loaded shaft such that the temperature sensor extends above a top surface of the grate when no cooking utensil is supported on the grate and the spring-loaded shaft is compressed when the cooking utensil is supported on top of the grate.

5. The gas burner assembly of claim 1, wherein each of the plurality of flame ports extends through the circumferential wall at a non-zero angle relative to a radial direction.

6. The gas burner assembly of claim 1, wherein an igniter is mounted to the panel below the gas burner assembly adjacent the plurality of flame ports.

7. The gas burner assembly of claim 1, wherein fuel is received in the fuel chamber from a fuel passage that extends from an inlet to an outlet proximate the circular cap, the fuel passage being positioned above the fuel chamber.

8. The gas burner assembly of claim 7, wherein the fuel passage is integrally formed with the grate.

9. The gas burner assembly of claim 8, wherein a mixing tube is mounted to the grate in fluid communication with the inlet of the fuel passage and a fuel orifice for delivering the fuel into the mixing tube is positioned below the panel of the cooktop appliance such that fuel is delivered to the fuel passage through the mixing tube.

10. A cooktop appliance, comprising:

a panel having a top surface and a bottom surface;

a fuel orifice mounted to the panel adjacent the bottom surface of the panel; and a gas burner assembly positioned on the panel at the top surface of the panel, the gas burner assembly comprising:

a grate configured for supporting a cooking utensil above the panel of the cooktop appliance, the grate defining a cap having a bottom that is positioned below a counter surface when the cooktop appliance is installed on a counter;

a burner defining an air passage extending vertically through a center of the burner, the burner further defining a plurality of flame ports opening into the air passage from a fuel chamber;

a temperature sensor positioned within the air passage and configured to measure a temperature of the cooking utensil supported on the grate; and a cylindrical channel formed by the grate and surrounding the temperature sensor to shield the temperature sensor from a flame generated when fuel flowing out of the plurality of flame ports is ignited.

11. The cooktop appliance of claim 10, wherein the temperature sensor extends vertically through the panel of the cooktop and into a center of the air passage.

12. The cooktop appliance of claim 10, wherein the cylindrical channel extends vertically from a top surface of the grate to a horizontal plane defined by the plurality of flame ports.

13. The cooktop appliance of claim 10, wherein the temperature sensor is disposed on an end of a spring-loaded shaft such that the temperature sensor extends above a top surface of the grate when no cooking utensil is supported on the grate and the spring-loaded shaft is compressed when the cooking utensil is supported on top of the grate.

14. The cooktop appliance of claim 10, wherein the burner defines a circumferential wall defining a plurality of flame ports extending from the fuel chamber to the air passage, each of the plurality of flame ports extending through the circumferential wall at non-zero angle relative to a radial direction.

15. The cooktop appliance of claim 10, wherein the burner suspended above the panel of the cooktop appliance by the grate such that a bottom of the burner is positioned below a counter surface when the cooktop appliance is installed on a counter.

16. The gas burner assembly of claim 1, wherein the temperature sensor is disposed on an end of a shaft that extends through the air passage, and a deflector fixed to the shaft proximate the panel.

17. The cooktop appliance of claim 10, wherein the temperature sensor is disposed on an end of a shaft that extends through the air passage, and a deflector fixed to the shaft proximate the panel.

18. The gas burner assembly of claim 1, wherein the cylindrical channel is formed using an insulating ceramic.

19. The cooktop appliance of claim 10, wherein the cylindrical channel is formed using an insulating ceramic.

* * * * *